United States Patent [19]

Aczel et al.

[11] 4,085,032

[45] Apr. 18, 1978

[54] HYDROGEN DONOR SOLVENT COAL LIQUEFACTION PROCESS

[75] Inventors: Thomas Aczel; Karl W. Plumlee, both of Baytown, Tex.

[73] Assignee: Exxon Research & Engineering Co., Linden, N.J.

[21] Appl. No.: 755,174

[22] Filed: Dec. 29, 1976

Related U.S. Application Data

[63] Continuation-in-part of Ser. No. 686,813, May 17, 1976, Pat. No. 4,049,536, and a continuation-in-part of Ser. No. 686,814, May 17, 1976, Pat. No. 4,049,537, and a continuation-in-part of Ser. No. 686,827, May 17, 1976, Pat. No. 4,051,012, and a continuation-in-part of Ser. No. 686,828, May 17, 1976.

[51] Int. Cl.[2] ..... C10G 1/06

[52] U.S. Cl. ..... 208/10; 208/8

[58] Field of Search ..... 208/8, 10

[56] References Cited

U.S. PATENT DOCUMENTS 3,700,583 10/1972 Salamony et al. ..... 208/8

*Primary Examiner*—Delbert E. Gantz

*Assistant Examiner*—J. Thierstein

*Attorney, Agent, or Firm*—Llewellyn A. Proctor

[57] ABSTRACT

An indigenous aqueous stream can be treated and then recycled, with a suitable donor solvent, to a coal liquefaction zone to catalyze the reaction. In one embodiment, an aqueous fraction is separated from a coal liquefaction zone effluent, a quinone solids portion of the separated fraction is concentrated within the liquid by evaporation of water therefrom to form a slurry, and the slurry is then recycled to the coal liquefaction zone to catalyze the coal liquefaction reaction. Naturally occurring phenols and alkyl substituted phenols, also found within the aqueous stream, can also be converted to quinones, if desired, by a chemical reaction which favors the addition of hydroxyl consitutents to the phenols to form dihydroxy benzenes. Quinones, as disclosed in copending Applications Ser. No. 686,813 now U.S. Pat. No. 4,049,536; Ser. No. 686,814 now U.S. Pat. No. 4,049,537; Ser. No. 686,827 now U.S. Pat. No. 4,051,012 and Ser. No. 686,828, K. W. Plumlee et al, filed May 17, 1976, are suitable hydrogen transfer catalysts.

7 Claims, 1 Drawing Figure

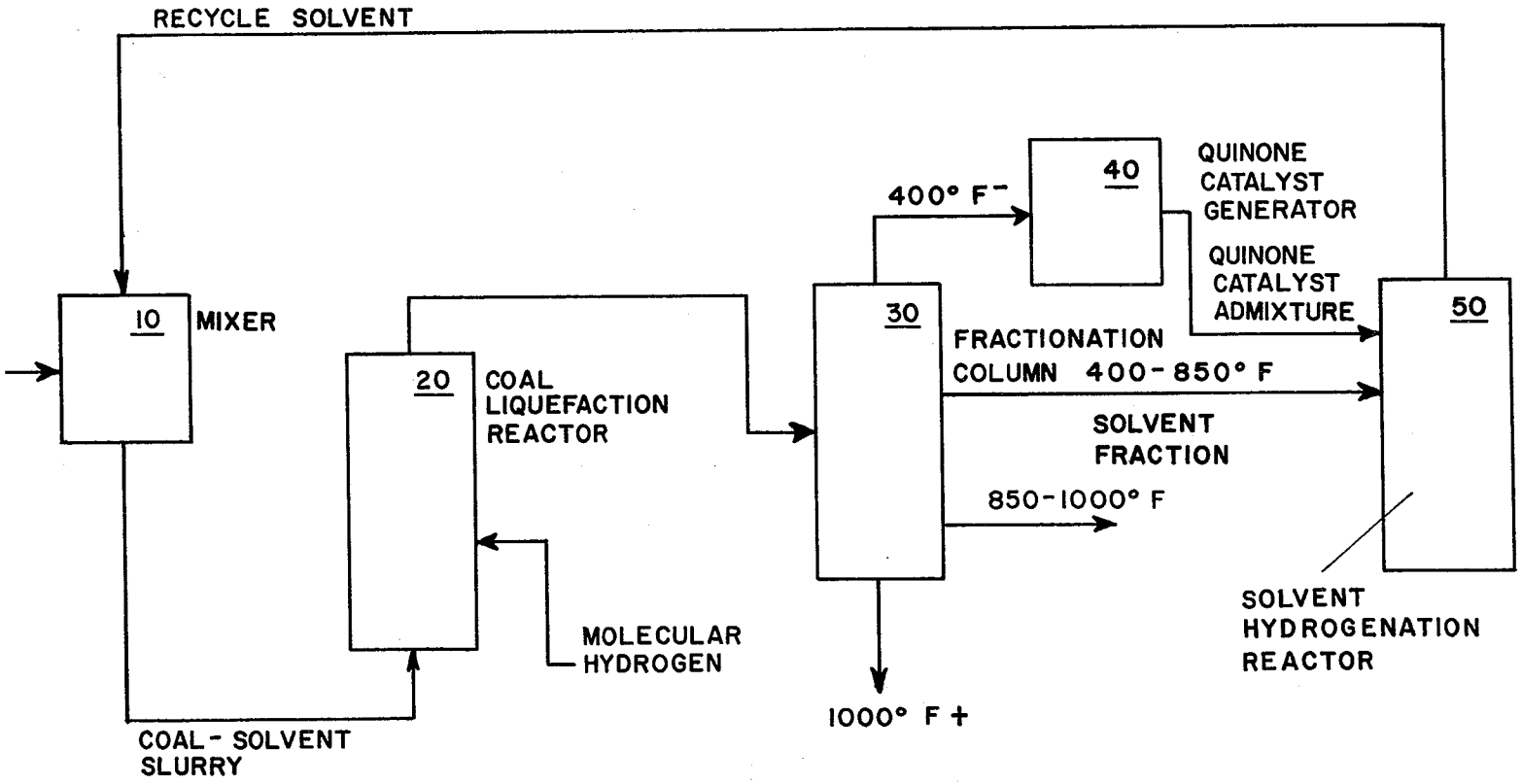
RECYCLE SOLVENT
10
MIXER
COAL - SOLVENT SLURRY
20
COAL LIQUEFACTION REACTOR
MOLECULAR HYDROGEN
30
FRACTIONATION COLUMN 400 - 850° F
400° F⁻
850-1000° F
1000° F +
SOLVENT FRACTION
40
QUINONE CATALYST GENERATOR
QUINONE CATALYST ADMIXTURE
50
SOLVENT HYDROGENATION REACTOR

HYDROGEN DONOR SOLVENT COAL LIQUEFACTION PROCESS

RELATED APPLICATION

This is a continuation-in-part of Application Ser. Nos. 686,813 now U.S. Pat. No. 4,049,536; 686,814 now U.S. Pat. No. 4,049,537; 686,827 now U.S. Pat. No. 4,051,012 and 686,828, filed May 17, 1976.

Hydrogen donor solvent processes for use in the hydrogenation and liquefaction of coal are of particular interest among known coal conversion processes for the production of useful petroleum-like liquids, i.e., 1000° F.− liquid products. In such processes, crushed coal is contacted at elevated temperature and pressure with a solvent, often a liquid fraction derived from within the process, which acts as a hydrogen transfer agent or donor. The solvent supplies hydrogen to the hydrogen-deficient coal molecules, as molecules are thermally cracked and cleaved from the disintegrating coal solids.

Coal is largely comprised of polymerized multi-ring aromatic structures, and in the breaking coal molecules each bond rupture results in the formation of extremely reactive free radicals. These moities, when early stabilized by the addition of a hydrogen atom, if sufficiently small may be evolved as a portion of the desired petroleum-like liquid product. If the moities become excessively large before they are stabilized, undesirable 1000° F.+ liquid products can form. Also, the moities can form polymeric products, and the fragments may remain with, or form a part of the char or coke that is produced. Sufficient hydrogen must be available, and effectively utilized to avoid repolymerization of the moities to form char or coke.

In the various competing reactions, however, gases, liquids and solids are inevitably formed; albeit efforts continue to increase the amount of petroleum-like liquids that are formed. In conventional practice, in any event, the gases are separated from the heavier products and the hydrocarbonaceous effluent slurry is fractionated into $C_1$-400° F., 400°-750° F., 750°-1000° F. and 1000° F.+ bottoms. Typically the $C_1$-400° F. hydrocarbon fraction is separated from an indigenous aqueous phase, the latter being discarded as a waste stream. The 400°-750° F. fraction is comprised of hydrogen donor compounds and accordingly, all or a portion of this fraction (or a 400°-850° F. fraction) is rehydrogenated in a hydrotreater, admixed and slurried with fresh coal, and then recycled to the coal liquefaction zone.

Quinones have been employed as carbon radical scavengers in coal liquefaction processes, as disclosed, e.g., in U.S. Pat. No. 3,700,583 issued to Salamony et al on Oct. 24, 1972. The Salamony et al process describes the use of quinones, particularly quinone derivatives of mono- and/or polynuclear aromatic compounds, and certain halogens and hydrogen halides as carbon-radical scavengers which are added with the hydrogen donor solvent fed to the coal liquefaction zone to increase the amount of liquid products, as measured by an increase in total amount of benzene-soluble liquids in the product. A preferred technique for adding quinones to the solvent, in accordance with Salamony et al, is to treat an indigenous 700°-1000° F. fraction of the liquid product in an oxidation zone to form the quinones, or carbon radical scavengers, in situ, and then to recycle such stream via the coal mixing zone to the coal liquefaction zone.

Quinones have also been used as hydrogen transfer catalysts in coal liquefaction processes as disclosed in U.S. application Ser. Nos. 686,813 now U.S. Pat. No. 4,049,536; 686,814 now U.S. Pat. No. 4,049,537; 686,827 now U.S. Pat. No. 4,051,012; and 686,828 by Plumlee et al, filed May 17, 1976, supra. In the Plumlee et al process a particulate coal feed is admixed with a hydrogen donor solvent to which a quinone has been added, and the mixture is then reacted in a coal liquefaction zone at conditions sufficient to hydroconvert and liquefy the coal. The products are then separated into fractions inclusive of a donor solvent fraction, the donor solvent fraction is hydrotreated in a hydrogenation zone in the presence of the quinone catalyst, and the hydrogenated solvent fraction is then recycled to said coal liquefaction zone. In this process, unlike the process of Salamony et al, the quinones accelerate the transfer of hydrogen to stabilize the free radicals formed by the disintegrating coal molecules, this resulting in an increase in liquid yield and decrease of coke or char due to the more effective hydrogen transfer produced by the quinone catalyst which suppresses recombination of the free radicals that tend to form high boiling polymers.

Whereas the process of Plumlee et al. offers these and other advantages over prior art processes, such process has nonetheless been found susceptible of further improvement.

Among the objects of this invention are:

To provide a new and improved process wherein quinone catalysts are recovered, or regenerated in situ within a hydrogen donor solvent process, admixed or slurried with fresh coal, and then recycled to the coal liquefaction zone to catalyze the coal liquefaction reaction and produce desirable 1000° F.− petroleum-like liquid products.

To provide a new and improved hydrogen donor coal liquefaction process, particularly one which utilizes a rich mixture of the ortho- and para- dihydroxy benzene isomers produced in situ and employed as a catalyst to produce greater quantities of the more useful petroleum-like liquids, with decreased amounts of char and coke.

These objects and others are achieved in accordance with the present invention wherein it has been discovered that an indigenous aqueous stream can be treated to concentrate indigenous quinone solids (i.e. quinone compounds, hydroquinone compounds, or admixture thereof) within the aqueous phase to form a slurry, and the slurry then recycled to the coal liquefaction zone (or zones), or hydrotreating zone (or zones), or both, to catalyze either, or both, of these reactions. In its preferred aspects, the quinone solids are merely concentrated by evaporation of liquid from the aqueous phase to form a thick slurry and then recycled without further treatment because, generally, the quinones are present as the major component of the solids and are catalytically active without further treatment. The solids portion of the aqueous stream, however, also contains phenols, and alkyl substituted phenols which can, if desired, also be converted to hydroquinones, there being suitable quinone catalysts for effecting hydrogen transfer reactions. In accordance with a further embodiment, therefore, the solids containing slurry is separated from the coal liquefaction zone effluent, the separated fraction is contacted with a peroxygen compound to convert indigenous phenolic components of the aqueous fraction into catalytic quinone components, which aqueous stream is suitable for recycle to the coal liquefaction zone, or hydrotreating zone, or both.

The indigenous aqueous fraction separated from the $C_1$–400° F. liquid hydrocarbon fraction taken from the coal liquefaction zone has been found to contain a major quantity of quinones, as well as phenol and alkyl substituted phenols. Typically, the $C_1$–400° F. liquid hydrocarbon stream taken from the distillation column employed to fractionate the liquid effluent from the coal liquefaction reactor is passed into an oil water separator wherein the liquid hydrocarbons and water are stratified as two distinct phases, and separated. Based on 100 pounds of coal feed, generally from about 10 pounds to about 25 pounds of the 400° F− product is separated in phases comprised of from about 6 pounds to about 12 pounds of water, and from about 4 pounds to about 13 pounds of $C_1$–400° F. liquid hydrocarbons. The aqueous phase is found to contain a major concentration of quinone compounds suitable per se as hydrogen transfer catalysts, and a lesser quantity of phenolic materials which can, if desired, be converted into quinone compounds suitable as hydrogen transfer catalysts. Most frequently, in view of the relatively high concentration of quinone compounds, a portion of the water is evaporated from the aqueous liquid and the slurry is recycled without additional treatment to the coal liquefaction reactor, or injected into the solvent hydrogenation reactor.

In one embodiment, however, the aqueous stream with or without a preliminary partial evaporation of water is contacted and treated with a peroxygen compound, or compounds, at conditions suitable to convert the phenolic compounds to dihydroxy benzenes. Such conversion reaction is generally conducted at temperatures ranging from ambient up to the boiling temperature of the aqueous phase, suitably from about 30° to about 210° F., and preferably from about 100° to about 180° F. Pressure is not critical, and the reaction is generally conducted at ambient pressure.

The peroxygen compound is added in amount sufficient to hydroxylize or introduce hydroxyl groups into the nuclei of the phenolic compounds to convert said phenolic compounds into hydroquinones. Hydrogen peroxide, or an admixture of hydrogen peroxide and a metal salt, or an admixture of hydrogen peroxide and an organic carboxylic acid, or a reaction product of hydrogen peroxide and an organic carboxylic acid, preferably one wherein the organic carboxylic acid is characterized as containing from 1 to about 4 carbon atoms and one carboxyl group, constitutes a preferred peroxygen compound, or compound capable of converting the phenols to dihydroxy benzenes, or hydroquinones. Preferably both the hydrogen peroxide and organic carboxylic acid, or reaction product thereof, are employed in the reaction. Exemplary of the organic carboxylic acids which can be added with, or reacted with the hydrogen peroxide, are formic acid, acetic acid, propionic acid, butanoic acid, pentanoic acid, and the like. Formic acid is preferred, and produces higher hydroxylation of the phenolic compounds on a weight basis than the higher molecular weight organic carboxylic acids.

In conducting the hydroxylation reaction, the hydrogen peroxide and organic carboxylic acid can be added in substantially stoichiometric amounts, but preferably each are added in amounts ranging from about 0.1 to about 0.6 moles, more preferably from about 0.2 to about 0.4 moles, based on the moles of phenolic compounds to be hydroxylated. Preferably also, a strong mineral acid is added to catalyze the hydroxylation reaction, e.g., hydrogen chloride, sulfuric acid, nitric acid, phosphoric acid, or the like.

The quinone catalyst generated in situ in accordance with the present invention is characterized as an admixture of quinone compounds, a quinone compound of such admixture being identified as a compound wherein two keto or hydroxy groups are connected by a system of conjugated double bonds. It is a mono- or polycyclic hydrocarbon compound which contains two oxygen atoms which occupy either ortho or para positions, one oxygen atom relative to the other. Where the quinone is polycyclic, the rings constituting the molecule can be fused or non-fused, or can contain both fused and non-fused rings. The quinone generally contains from 1 to about 3 rings in the total molecule, and most often from 1 to about 2 rings. The rings can be substituted or unsubstituted, and generally the rings are substituted. In terms of carbon atoms the total molecule generally contains from 6 to about 20 carbon atoms, most often from 6 to about 12 carbon atoms. The keto or hydroxy groups, while occupying positions ortho or para one to the other, can be located on the same or different rings. Polynuclear polyquinones are present, but the diquinones are present in highest concentration. Exemplary of quinone compounds found in such admixture as major components are such species as ortho and para dihydroxybenzene; methyl, ethyl and propyl substituted ortho and para dihydroxybenzene; dimethyl substituted ortho and para dihydroxybenzene and trimethyl and methylethyl substituted ortho and para dihydroxybenzene, and the like. The ortho-hydroquinones are a preferred species, as contrasted with the para-hydroquinones and fortunately, the ortho-hydroquinones are present in an essentially 2:1 mole concentration relative to the para-hydroquinones. The least catalytically effective isomer, i.e., the meta-dihydroxy benzenes, are usually present only in trace amounts within the admixture.

In a preferred embodiment, the generated admixture of quinone compounds, alone or in admixture with additional quinone compounds from another source, is added to a liquid fraction separated from the liquid products obtained from within the process, suitably a fraction boiling within the range of from about 350° to about 850° F., and preferably from about 400° to about 700° F. These fractions have been found admirably suitable as a solvent donor, solvent donor vehicle or precursor, and generally contain about 30 percent, and most often about 50 percent, of an admixture of hydrogen donor compounds, adequate to supply the necessary hydrogen under coal liquefaction conditions, based on the total weight of the recycled solvent. Where such amounts of hydrogen donor compounds are not present in a given solvent vehicle, additional amounts of these materials can be produced. Suitably, the quinone compound is added to the solvent fraction in quantity ranging from about 0.01 to about 5 percent, preferably from about 0.1 to about 2 percent, based on the weight of total solvent fed into the coal liquefaction zone.

Preferred hydrogen donor compounds are added to, or generated in situ from precursors contained within a suitable solvent donor vehicle, these including indane, dihydronaphthalene, $C_{10}$–$C_{12}$ tetrahydronaphthalenes, hexahydrofluorine, the dihydro-, tetrahydro-, hexahydro-, and octahydro-phenanthrenes, $C_{12}$–$C_{13}$ acenaphthenes, the tetrahydro-, hexahydro- and decahydropyrenes, the ditetra- and octahydro-anthracenes, and other derivatives of partially saturated aromatic compounds. In terms of hydrogen donor potential, the solvent to which the quinone compound has been added, at the time of its introduction into or use within the coal liquefaction zone, necessarily contains at least about 0.8 percent, and preferably from about 1.2 to about 3 percent of donatable hydrogen, based on the weight of total solvent introduced into the coal liquefaction zone. The preferred hydrogen donor solvent is one produced within the coal liquefaction process, and one which contains suitable quantities of hydrogen donor precursors.

In the best mode of practicing the present invention, the admixture of quinone compounds, is employed as a homogeneous catalyst to hydrogenate a hydrogen donor solvent fraction produced from within the coal liquefaction process. In such process, schematically illustrated by reference to the FIGURE, the required process steps include (a) a mixing zone 10 within which particulate coal is slurried with an internally generated liquid solvent donor fraction, (b) a coal liquefaction zone 20 within which the coal slurry is fed, and the coal liquefied, (c) a distillation and solids separation zone 30 from which is obtained a mixed phase 400° F.− fraction, a liquid solvent fraction, a liquid product fraction, and a 1000° F.+ heavy bottoms fraction, (d) an oil water separator 40A from which the $C_1$–400° F. hydrocarbons of the 400° F.− feed from separator 30 are separated from an aqueous component, and a vacuum distillation zone 40B wherein the quinone solids are concentrated within a slurry faction suitable for recycle by removal of water and (e) a catalytic solvent hydrogenation zone 50 wherein the liquid solvent fraction is hydrogenated in the presence of the quinone catalyst admixture, and the hydrogenated solvent is recycled as a hydrogen donor solvent to said coal liquefaction zone.

In the mixing zone 10, particulate coal of size ranging up to about ⅛ inch particle size diameter, suitably 8 mesh (Tyler), is slurried in recycle solvent. The solvent and coal are admixed in a solvent-to-coal ratio ranging from about 0.8:1 to about 2:1, preferably about 1.2:1 to about 1.6:1, based on weight. The solvent is one which boils within the range of about 350° to about 850° F., preferably from about 400° to about 700° F. The coal slurry is fed, with molecular hydrogen, into the coal liquefaction zone 20.

Within the coal liquefaction zone 20, liquefaction conditions include a temperature ranging from about 700° to about 950° F., preferably from about 800° to about 900° F., with pressures ranging from about 300 psig to about 3000 psig, preferably from about 800 psig to about 2000 psig. Preferably, molecular hydrogen is also added to the liquefaction zone 20 at a rate from about 1 to about 6 weight percent (MAF coal basis), liquid residence times ranging from about 5 to about 130 minutes, and preferably from about 10 to about 60 minutes.

The product from the coal liquefaction zone 20 consists of gases and liquids, the liquids including a mixture of undepleted hydrogen-donor solvent, depleted hydrogen-donor solvent, dissolved coal, undissolved coal and mineral matter. The liquid mixture is transferred into a separation zone 30 wherein a light fraction boiling below 400° F. and an intermediate fraction boiling, e.g., from 400° to 850° F., are recovered, the latter for use as a hydrogen donor solvent. A heavier fraction boiling from about 850° to 1000° F. is also recovered and, as well, a bottoms fractions boiling above 1000° F., including char. The latter is generally used in a gasification process or for coking, as desired.

The 400° F.− product stream withdrawn from fractionation column 30 is comprised of aqueous and $C_1$–400° F.− liquid hydrocarbon portions. The 400° F.− liquid is introduced into an oil-water separator 40A whereupon the liquids are stratified into an upper $C_1$–400° F. hydrocarbons are drawn off and recovered, and the water layer, which contains generally from about 10 to about 20 percent solids, a majority of which are quinone compounds, generally in admixture with phenolic compounds, is introduced into a vacuum distillation column 40B. Water is separated therefrom, and the quinone catalyst containing slurry is then introduced into the solvent hydrogenation reactor 50 or, if desired fed directly or indirectly to the coal liquefaction reactor 20.

The solvent fraction, or 400°–850° F. fraction, is also introduced into a solvent hydrogenation zone 50 and hydrogenated in the presence of a quinone catalyst to upgrade the hydrogen content of that fraction. The conditions maintained in hydrogenation zone 50 effectively hydrogenate and, if desired, conditions can be provided which produce substantial cracking. Temperatures normally range from about 500° to about 1000° F., preferably from about 750° F. to about 900° F., and pressures suitably range from about 650 psig to about 2000 psig, preferably from about 1000 psig to about 1400 psig. The hydrogen treat rate ranges generally from about 500 to about 10,000 SCF/B, preferably from about 1000 to about 5000 SCF/B.

These and other features of the present process will be better understood by reference to the following exemplary data. All units are in terms of weight unless otherwise specified.

EXAMPLE

A water fraction was recovered in an oil-water separator from the 400° F− boiling range fraction of product from the liquid effluent of a Donor Solvent Coal Liquefaction process. The separation was accomplished through the density difference between the organic and aqueous phases with the more dense aqueous phase being decanted. A direct analysis of the aqueous phase using mass spectrometry was made, the results of the analysis being given in the second column of the table.

Subsequent to analysis of the aqueous phase, the hydroquinones of the hydroquinone containing aqueous phase were concentrated by drying in a vacuum over [29 inches (of water) vacuum] at 130°–150° F. for several hours. The resultant crystalline material was analyzed using mass spectrometry and the relative concentrations thereof is given in the third column of the table.

TABLE

PHENOLS AND DIHYDROXY BENZENES IN INDIGENOUS WATER FROM COAL LIQUEFACTION REACTORS

| | Concentration, Weight Percent | |
|---|---|---|
| | In Original Water | In Crystals |
| Components Phenols | | |
| $C_6$ | 0.17 | — |
| $C_7$ | 0.11 | — |
| $C_8$ | 0.06 | — |
| $C_9$* | 0.13 | 10.31* |
| $C_{10}$ | 0.13 | 0.93 |
| $C_{11}$ | 0.07 | 0.38 |
| $C_{12}$ | — | 0.16 |
| Dihydroxybenzenes | | |

TABLE-continued

PHENOLS AND DIHYDROXY BENZENES IN INDIGENOUS WATER FROM COAL LIQUEFACTION REACTORS

| | Concentration, Weight Percent | |
|---|---|---|
| | In Original Water | In Crystals |
| $C_6$ | 1.60 | 33.10 |
| $C_7$ | 0.78 | 12.09 |
| $C_8$ | 0.13 | 1.62 |
| $C_9$ | 0.07 | 0.22 |
| Solid Residue | — | 31.90 |
| $H_2O$ | >71.50 | — |
| Total | >74.75 | 90.71 |

*Mostly unknown material of MW 136.

The slurry of quinone compounds is found highly suitable as a hydrogen transfer catalyst when recycled to the coal liquefaction reactor.

It is apparent that various modifications and changes can be made without departing the spirit and scope of the present invention.

Having described the invention what is claimed is:

1. In a process for liquefying a particulate coal feed to produce useful petroleum-like liquid products by the steps of contacting, in a liquefaction zone, said coal feed with a hydrogen donor solvent and a quinone catalyst at temperature and pressure sufficient by hydroconvert and liquefy the coal, separating the product from the liquefaction zone into fractions inclusive of a 400° F.— liquid fraction and a liquid solvent fraction which contains at least 30 weight percent hydrogen donor compounds, hydrogenating said liquid solvent fraction in a hydrogenation zone, and recycling the hydrogenated liquid solvent mixture to said coal liquefaction zone, the improvement comprising passing said 400° F.— liquid fraction into an oil-water separation zone, and stratifying said 400° F.— liquid fraction into a $C_1$–400° F. liquid hydrocarbon phase and an aqueous slurry phase which contains quinone catalyst, separating said aqueous slurry phase from said $C_1$–400° F. hydrocarbon phase, passing said aqueous slurry phase into a vacuum distillation zone and removing water from said slurry to concentrate the quinone catalyst within said phase, and then recycling said quinone catalyst containing aqueous slurry phase to said solvent hydrogenation zone or to said coal liquefaction zone, or both, to catalyze either or both of these reactions.

2. The process of claim 1 wherein the separated aqueous slurry phase obtained by separation of $C_1$–400° F. liquid hydrocarbons therefrom is a slurry which contains an admixture of indigenous phenolic compounds and quinone catalyst, and the phenolic compounds are converted to quinone catalyst by contacting said aqueous slurry phase with hydrogen peroxide, alone or in admixture with other compounds, sufficient to introduce hydroxyl groups into the nuclei of the phenolic compounds to convert said phenolic compounds into hydroquinones, and then recycling said stream to said solvent hydrogenation zone, or to said coal liquefaction zone, or both, to catalyze said reactions.

3. The process of claim 1 wherein hydrogen peroxide contacted with the aqueous phase to introduce the hydroxyl groups into the nuclei of the phenolic compounds is admixed with an organic carboxylic acid.

4. The process of claim 3 wherein the organic carboxylic acid is one containing from 1 to about 4 carbon atoms, and one carboxylic acid group.

5. The process of claim 4 wherein the organic carboxylic acid is formic acid.

6. The process of claim 1 wherein the liquid solvent fraction contains at least 50 weight percent of hydrogen donor compounds.

7. The process of claim 6 wherein the liquid solvent fraction is one boiling within about a 350° to 850° F. range.

* * * * *